US009485842B2

(12) United States Patent
Kadotani et al.

(10) Patent No.: US 9,485,842 B2
(45) Date of Patent: Nov. 1, 2016

(54) LIGHTING SYSTEM AND CONTROL DEVICE

(71) Applicant: Panasonic Intellectual Property Management Co., Ltd., Osaka (JP)

(72) Inventors: Kazuyoshi Kadotani, Osaka (JP); Hajime Koide, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/961,641

(22) Filed: Dec. 7, 2015

(65) Prior Publication Data

US 2016/0174341 A1 Jun. 16, 2016

(30) Foreign Application Priority Data

Dec. 10, 2014 (JP) ..... 2014-250099

(51) Int. Cl.
*H05B 37/02* (2006.01)
*H05B 33/08* (2006.01)

(52) U.S. Cl.
CPC ..... *H05B 37/0263* (2013.01); *H05B 33/0851* (2013.01); *H05B 37/0227* (2013.01)

(58) Field of Classification Search
CPC ..... H05B 41/24; H05B 41/04; H05B 37/02
USPC ..... 315/200 R, 209 R, 210–211, 246, 247, 315/291, 307, 312, 290
See application file for complete search history.

(56) References Cited

U.S. PATENT DOCUMENTS 8,664,886 B2 * 3/2014 Ostrovsky ..... H05B 33/0815 315/247
2012/0280633 A1 * 11/2012 Weightman ..... H05B 39/08 315/200 R
2014/0265897 A1 * 9/2014 Taipale ..... H05B 37/02 315/200 R

FOREIGN PATENT DOCUMENTS

JP 08-126200 A 5/1996
JP 2004-180412 A 6/2004
JP 2009-225629 A 10/2009
JP 2009-240032 A 10/2009
JP 2009-240054 A 10/2009
JP 2011-024284 A 2/2011
JP 2011-076801 A 4/2011
JP 2012-163304 A 8/2012

* cited by examiner

*Primary Examiner* — Minh D A
(74) *Attorney, Agent, or Firm* — McDermott Will & Emery LLP

(57) ABSTRACT

A lighting system includes a lighting fixture, a demand controller and a control board. The demand controller obtains power usage of a plurality of devices including the lighting fixture and, outputs a demand signal depending on the power usage obtained. The control board includes a switch provided on a power line and a switch controller that interrupts supply of power over the power line for a predetermined period of time by controlling the switch based on the output demand signal. The lighting fixture includes a light emitter, a detector, and a controller that causes the light emitter to emit light in a second dimming state darker than a first dimming state in which the light emitter emitted light immediately before the detection, if the detector detects that the supply of power has been interrupted for the predetermined period of time.

9 Claims, 6 Drawing Sheets

LIGHTING SYSTEM AND CONTROL DEVICE

CROSS REFERENCE TO RELATED APPLICATION

This application claims the benefit of priority of Japanese Patent Application Number 2014-250099, filed on Dec. 10, 2014, the entire content of which is hereby incorporated by reference.

BACKGROUND

1. Technical Field

The present disclosure relates to lighting systems and control devices compatible with demand control.

2. Description of the Related Art

Energy management systems have gained attention in recent years with the stabilization of power grids and increase in freedom in the energy market. For example, a demand control system is known which predicts consumer power usage (demand) and controls electrical devices (e.g., air conditioners and lights) belonging to the consumer to keep power usage from exceeding the consumer's contract demand (e.g., refer to Japanese Unexamined Patent Application Publication No. 2009-240032).

SUMMARY

When, for example, a demand control system for controlling lighting fixture demand is newly installed at a relatively large consumer site, such as an office building, extensive construction work is required.

Thus, in one general aspect, the present disclosure provides a lighting system that is compatible with demand control and easily installed, and a control device used by such a lighting system.

In one general aspect, the present disclosure describes a lighting system that includes a lighting fixture, a demand controller and a control device. The lighting fixture is to be connected to a distribution board via a power line and emits light when supplied with power over the power line. The demand controller obtains power usage of a plurality of devices, including the lighting fixture, connected to the distribution board via power lines, and outputs a demand signal based on the power usage obtained. The control devices includes a switch provided on the power line connected to the lighting fixture and a switch controller that interrupts supply of power over the power line for a predetermined period of time by controlling the switch based on the demand signal output by the demand controller. The lighting fixture includes a light emitter that emits light when supplied with power over the power line, a detector that detects an interruption in the supply of power, and a controller that causes the light emitter to emit light in a second dimming state if the detector detects that the supply of power has been interrupted for the predetermined period of time, the second dimming state being darker than a first dimming state in which the light emitter emitted light immediately before the detection that the supply of power has been interrupted for the predetermined period of time.

In one general aspect, the present disclosure describes a control device that includes a switch provided on a power line connecting a distribution board and a lighting fixture, and a switch controller that interrupts supply of power to the lighting fixture for a predetermined period of time by controlling the switch based on a demand signal outputted depending on power usage of a plurality of devices, including the lighting fixture, connected to the distribution board via power lines.

Accordingly, a lighting system that is compatible with demand control and easily installed can be realized.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENT

Figure 1:
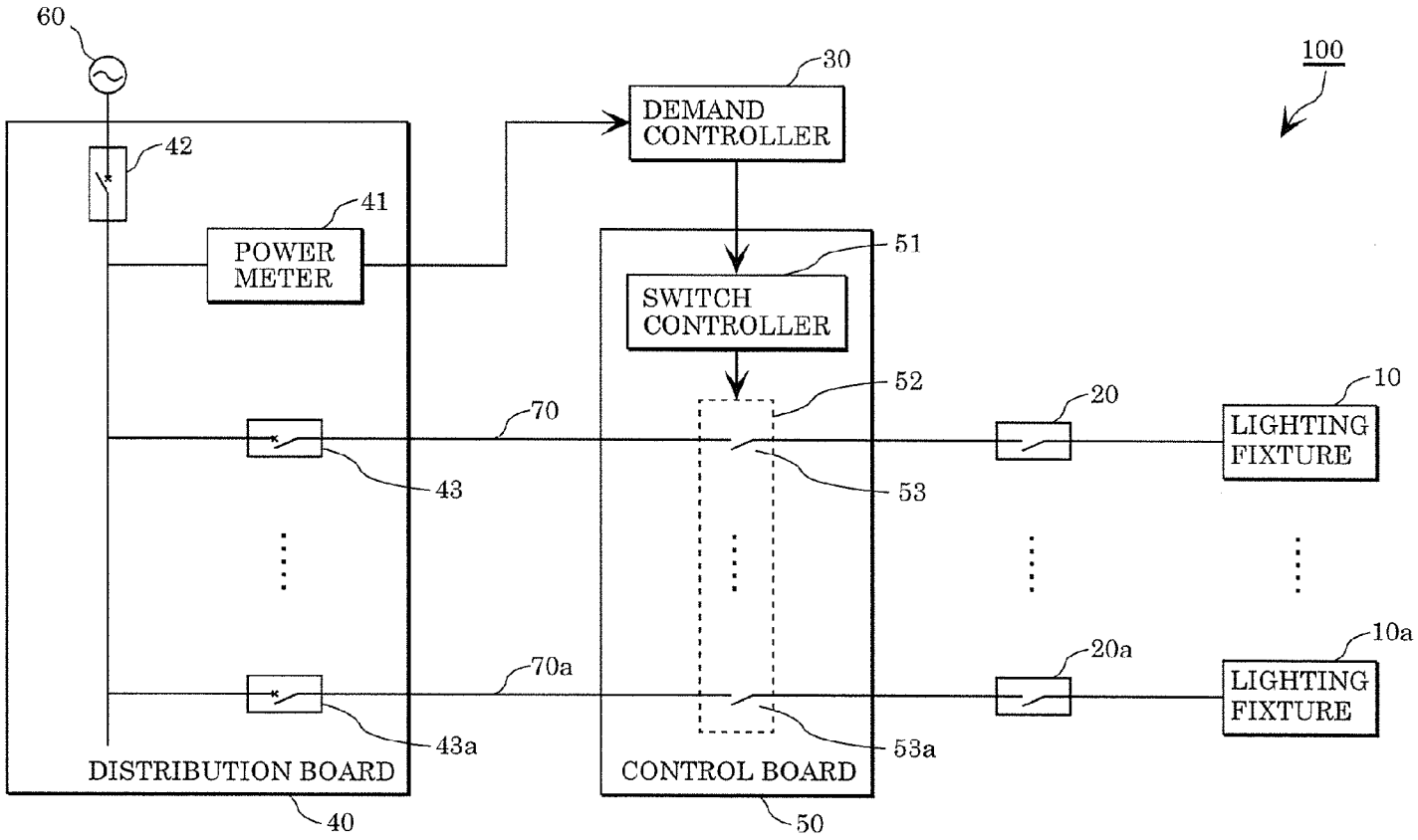
FIG. 1 is a block diagram of a lighting system according to Embodiment 1.

Hereinafter, a lighting system according to a non-limiting embodiment will be described with reference to the drawings. It should be noted that the following embodiment shows a general or specific example. The numerical values, shapes, elements, the arrangement and connection of the elements etc., shown in the following embodiment are mere examples, and therefore do not limit the present disclosure. As such, among the elements in the following embodiment, those not recited in any one of the independent claims which indicate the broadest inventive concepts are described as arbitrary elements.

Note that the drawings are represented schematically and are not necessarily precise illustrations. Additionally, essentially similar elements share like reference numbers in the drawings, and duplicate descriptions are omitted or simplified.

Embodiment 1

General Configuration of Lighting System

First, the general configuration of the lighting system according to Embodiment 1 will be described. FIG. 1 is a block diagram of the lighting system according to Embodiment 1.

As illustrated in FIG. 1, lighting system 100 includes a plurality of lighting fixtures (e.g., lighting fixture 10 and lighting fixture 10*a*), demand controller 30, distribution board 40, and control board 50. FIG. 1 also illustrates power line 70, which connects lighting fixture 10 and distribution board 40 together, and in addition illustrates wall switch 20 provided on power line 70. FIG. 1 also similarly illustrates power line 70*a*, which connects lighting fixture 10*a* and distribution board 40 together, and in addition illustrates wall switch 20*a* provided on power line 70*a*. Note that the number of lighting fixtures included in lighting system 100 is not limited to a particular number.

One feature of lighting system 100 is the dimming of the lighting fixtures when the total power usage of devices connected to distribution board 40 increases. Hereinafter, each element in lighting system 100 will be described in detail.

Lighting fixture 10 is connected to distribution board 40 via power line 70 and emits light with power supplied over power line 70. The configuration of lighting fixture 10 will be described in detail later. Note that lighting fixture 10*a* has the same configuration as lighting fixture 10, and as such, description of lighting fixture 10*a* will be omitted.

Wall switch 20 is a switch that allows the user to turn lighting fixture 10 on or off, and is attached to a building wall. Wall switch 20 may be any ordinary switch. The same applies for wall switch 20*a*.

Distribution board 40 supplies power from power grid 60 (utility grid) to each of the devices (i.e., each of the circuits) connected to distribution board 40 via power lines. In this example, devices connected to distribution board 40 include lighting fixture 10 and lighting fixture 10*a*, but other devices such as air conditioners may also be included. Distribution board 40 may also be a light board to which only lighting fixtures are connected.

Distribution board 40 includes a box-shaped housing (not illustrated in the drawings) including main breaker 42 and a branch circuit breaker for each power line (circuit) connected to distribution board 40 (exemplified as branch circuit breaker 43 and branch circuit breaker 43*a* in FIG. 1).

Main breaker 42 is a breaker that interrupts the supply of power from power grid 60 when power supplied from power grid 60 exceeds a predetermined power (power defined by contract with the power company).

Branch circuit breaker 43 and branch circuit breaker 43*a* are breakers that interrupt the supply of power (current) to a connected power line when overcurrent flows to the power line.

In Embodiment 1, distribution board 40 also includes power meter 41. Power meter 41 is a device that measures the total power usage of the devices connected to distribution board 40 via power lines. Power meter 41 outputs the measured power usage to demand controller 30 as a measurement signal.

Demand controller 30 is a device that manages operation states and power usage of the devices connected to distribution board 40 via power lines.

In Embodiment 1, demand controller 30 obtains power usage of a plurality of devices—including the lighting fixture—connected to distribution board 40 via power lines and, depending on the power usage obtained, outputs a demand signal. More specifically, demand controller 30 obtains the total power usage of the plurality of devices measured by power meter 41 included in distribution board 40, and, if the total power usage obtained is predicted to exceed a predetermined target usage, outputs a demand signal. Note that in Embodiment 1, power meter 41 and demand controller 30 are connected via a wired connection using a communication line, but power meter 41 and demand controller 30 may be connected via a wireless connection. In this case, the communication method used is not limited to a particular method.

Demand controller 30 predicts that power usage will exceed the target usage if the power usage exceeds a predetermined threshold (e.g., 80% of the target usage) and remains above the predetermined threshold for a predetermined period of time. In other words, when power usage exceeds a predetermined threshold and remains above the predetermined threshold for a predetermined period of time, demand controller 30 outputs a demand signal. Note that the demand signal is, for example, a binary electrical signal that has a high-level waveform when power usage is predicted to exceed the target usage and has a low-level waveform at all other times, but the demand signal may be any other kind of signal.

Note that a plurality of the predetermined thresholds described above may be used. For example, demand controller 30 may output a first demand signal when power usage exceeds a first threshold (e.g., 80% of the target usage) and output a second demand signal when power usage exceeds a second threshold (e.g., 90% of the target usage).

Note that demand controller 30 may obtain the total power usage from a smart meter that is provided separately from distribution board 40 and measures power usage of the plurality of devices connected to the distribution board, or from an external server (e.g., a server maintained by the power supply company). In this case, demand controller 30 may communicate with, for example, the smart meter over any given type of wired or wireless communications network. The method of communication (i.e., the communications standard used) is not limited to a particular method.

Note that the target usage and the predetermined threshold are configurable by the user via a user interface of demand controller 30 (not illustrated in FIG. 1).

Control board 50 is one example of the control device, and includes switch unit 52, which includes a plurality of switches (exemplified as switch 53 and switch 53*a* in FIG. 1), and switch controller 51. Note that switch 53 and switch 53*a* essentially have the same functions. As such, hereinafter, switch 53 will be described, and description of switch 53*a* will be omitted.

Switch unit 52 is a switching device including a plurality of switches. On and off states of the switches are controlled by switch controller 51. Switch unit 52 includes switch 53 and switch 53*a*.

Switch 53 is provided on power line 70 connected to lighting fixture 10. Switch 53 is realized as, for example, a relay element or a power transistor.

Switch controller 51 interrupts supply of power to the plurality of lighting fixtures by controlling the plurality of switches included in switch unit 52 (e.g., switch 53 and switch 53*a*) based on a demand signal output by demand controller 30. In other words, switch controller 51 performs control of, based on a demand signal, turning switch 53 and switch 53*a* off for a predetermined period of time and then turning them on again (hereinafter, this control may simply be described as momentarily turning off a switch—that is to say, referred to as causing a switch to perform a "momentary power-off operation").

More specifically, switch controller 51 turns the plurality of switches included in switch unit 52 on and off with an electrical signal (control signal). Switch controller 51 is realized as, for example, a specialized circuit, but may be realized as a processor or microcomputer.

Note that in Embodiment 1, switch controller 51 (control board 50) and demand controller 30 are connected via a wired connection using a communication line, over which the demand signal is transmitted and received. However, switch controller 51 and demand controller 30 may communicate, for example, wirelessly. Moreover, the method of communication (i.e., the communications standard used) is not limited to a particular method.

Configuration of Lighting Fixture

Figure 2:
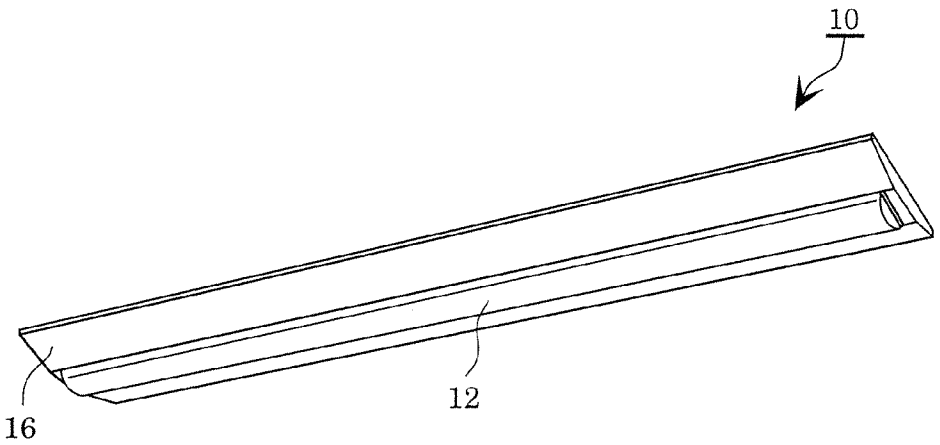
FIG. 2 is an external view of a lighting fixture according to Embodiment 1.

Next, the configuration of lighting fixture 10 will be described in detail. FIG. 2 is an external view of lighting fixture 10, and FIG. 3 is a functional block diagram of lighting fixture 10.

Figure 3:
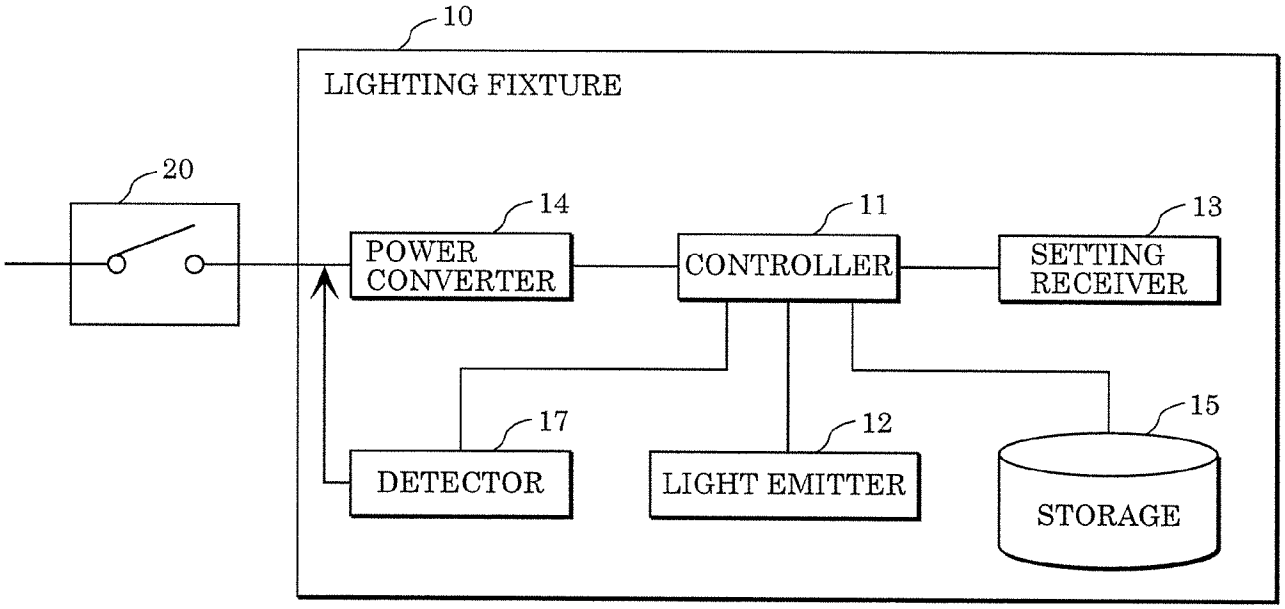
FIG. 3 is a functional block diagram of a lighting fixture according to Embodiment 1.

As illustrated in FIG. 2 and FIG. 3, lighting fixture 10 includes fixture main body 16, light emitter 12, power converter 14, detector 17, controller 11, setting receiver 13, and storage 15.

Fixture main body 16 forms the base of lighting fixture 10, and is fixed to the ceiling with, for example, nuts and bolts.

Light emitter 12 emits light with power supplied from power line 70 (more specifically, with power supplied from controller 11). Light emitter 12 more specifically includes a light-emitting module and a cover that covers the light-emitting module.

The light-emitting module includes LED elements mounted on a substrate as the light-emitting elements. The light-emitting module may be a chip on board (COB) module in which LED chips are directly mounted on the substrate. The light-emitting module may also be a surface mount device (SMD) module in which SMD LED elements are mounted on the substrate. Note that an SMD LED element is a package LED in which an LED chip is mounted and sealed with phosphor in the cavity of a resin package.

The cover transmits light emitted by the light-emitting module. The cover is made from light-transmissive glass or resin, but may be made from a white resin containing a light diffusing material (light diffusing particles) such as silica or calcium carbonate.

Power converter 14 converts AC power supplied from power grid 60 via power line 70 to DC power, and outputs the converted DC power to controller 11. More specifically, power converter 14 is, for example, a full-wave bridge rectifier circuit, but may be any other kind of converter, such as an AC-DC converter integrated circuit (IC).

Detector 17 detects an interruption in the supply of power from power line 70. More specifically, detector 17 detects an instance of the supply of power being interrupted for a predetermined period of time (i.e., detects an instance of the momentary power-off operation). Here, the length of the predetermined period of time is, for example, between one and two seconds, inclusive, but the predetermined period of time is not limited to any particular length.

Detector 17 is, for example, a circuit including a detection circuit that detects an instance of the momentary power-off operation of switch 53. The configuration of the detection circuit will be described in detail later. Note that detector 17 may be realized as a microcomputer or processor.

Controller 11 controls light emission of light emitter 12 using the DC power output by power converter 14. In Embodiment 1, directly after detector 17 detects an instance of the momentary power-off operation of switch 53 (i.e., detects that the supply of power has been temporarily interrupted for the predetermined period of time and is resumed), controller 11 causes light emitter 12 to emit light in a second dimming state darker than a first dimming state in which light emitter 12 emitted light immediately before the detection.

Moreover, while controller 11 is causing light emitter 12 to emit light in the second dimming state, if detector 17 detects that the supply of power from power line 70 to lighting fixture 10 has been interrupted for a period longer than the predetermined period of time and the supply of power resumes, controller 11 causes light emitter 12 to emit light in the first dimming state. In other words, lighting fixture 10 is returned to the first dimming state from the second dimming state. In Embodiment 1, the period longer than the predetermined period of time (this longer period is also referred to as a first predetermined period of time) is longer than two seconds, but this period is not limited to a particular length.

With this, when the user turns wall switch 20 off and turns wall switch 20 back on after a period of time longer than the above-described momentary power-off operation lasts, light emitter 12 can be returned to the first dimming state. Note that switch controller 51 may return light emitter 12 to the first dimming state from the second dimming state based on the demand signal by switching off switch 53. Light emitter 12 may also be returned by remote control by the user (i.e., by input of a command to setting receiver 13).

Controller 11 is, for example, a circuit including a chopper control circuit that adjusts power supplied to light emitter 12. The chopper control circuit is, more specifically, a pulse width modulation (PWM) circuit or a pulse frequency modulation (PFM) circuit, for example. Note that controller 11 may be realized as a microcomputer or processor.

Note that lighting fixture 10 can be configured to store enough power to operate controller 11 for a short period of time when the supply of power to lighting fixture 10 is interrupted. Here, "a short period of time" is at least a period of time longer than the predetermined period of time, but is preferably longer than the first predetermined period of time.

Moreover, lighting fixture 10 may be configured to store enough power to cause light emitter 12 to emit light for a length of time approximately equal to the predetermined period of time described above. With this, lighting fixture 10 can transition from the first dimming state to the second dimming state without turning off, even during the momentary power-off operation.

Setting receiver 13 receives a user setting for the first dimming state and the second dimming state. More specifically, setting receiver 13 is a light receptor of a remote control with which the user sets the first dimming state and the second dimming state. Note that a "dimming state" includes a state in which lighting fixture 10 is fully on (i.e., 100% not dimmed). In Embodiment 1, the first dimming state is, for example, a state in which lighting fixture 10 is fully on, and the second dimming state is, for example, a state in which lighting fixture 10 is dimmed to 80%.

Storage 15 is a storage device (memory) that stores dimming state settings received by setting receiver 13. The settings for the dimming states are referenced by controller 11. Storage 15 is semiconductor memory such as flash memory or electrically erasable programmable read-only memory (EEPROM). Note that storage 15 may be included in controller 11.

Momentary Power-off Operation Detection Circuit

Figure 4:
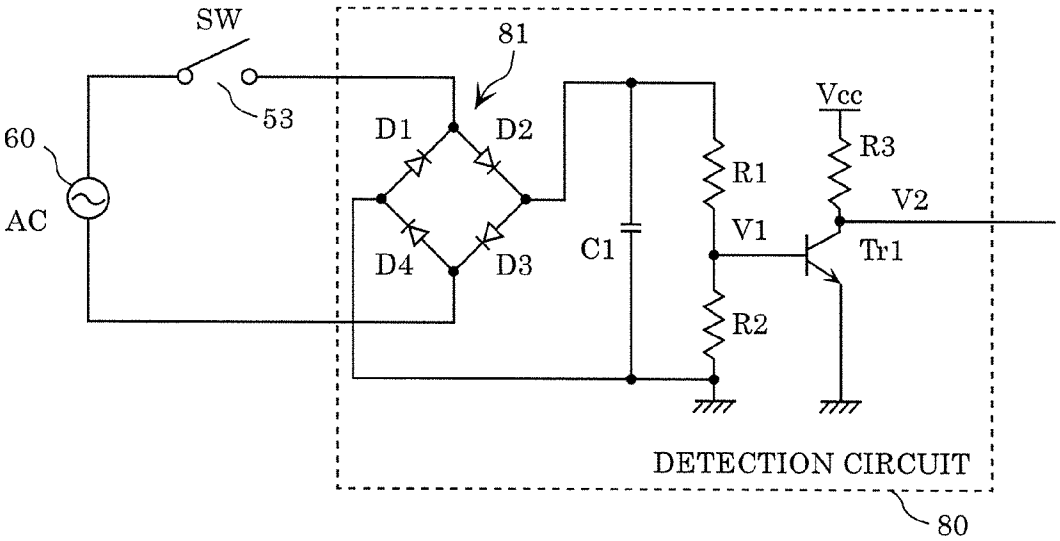
FIG. 4 is a circuit diagram of a detection circuit.
Figure 5:
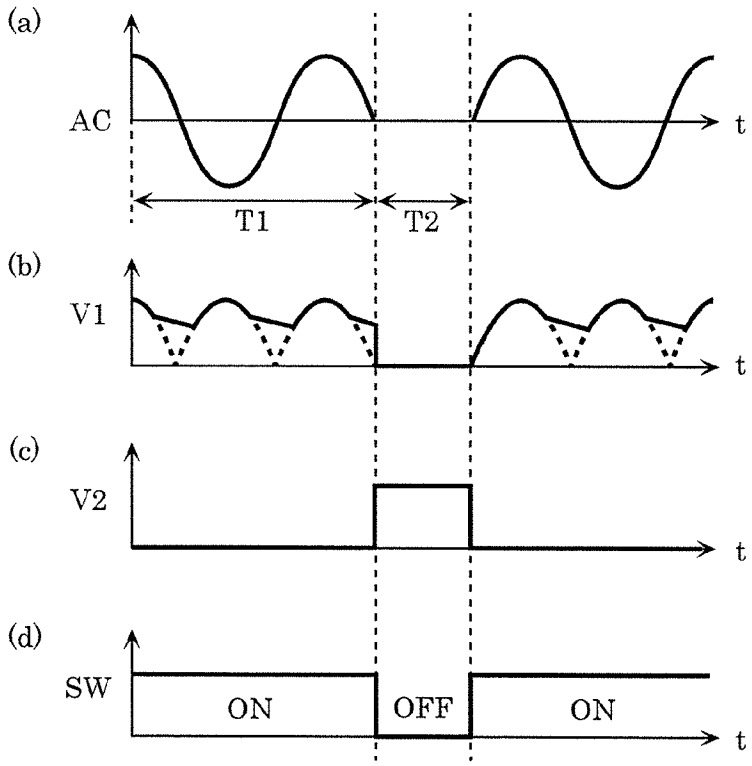
FIG. 5 schematically illustrates voltage waveforms in a detection circuit.

Next, an example of the detection circuit, included in detector 17, for detecting an instance of the momentary power-off operation of switch 53 will be given. FIG. 4 is a circuit diagram of the detection circuit. FIG. 5 illustrates voltage waveforms in the detection circuit. Note that in FIG. 4, only the configuration related to detection of an instance of the momentary power-off operation is illustrated. Moreover, FIG. 5 is illustrated schematically and, as such, does not accurately indicate voltage waveform levels and frequencies.

Detection circuit 80 is for detecting an instance of the momentary power-off operation of switch 53 from power grid 60. Detection circuit 80 includes full-wave rectifier circuit 81 including four diodes D1 through D4. Full-wave rectifier circuit 81 rectifies power grid AC voltage illustrated in (a) in FIG. 5 with diodes D1 through D4. Note that when power converter 14 includes a full-wave rectifier circuit, this full-wave rectifier circuit may be used instead of full-wave rectifier circuit 81.

The rectified voltage is smoothed by smoothing capacitor C1, divided by resistor R1 and resistor R2, and input into transistor Tr1 as a base voltage of transistor Tr1. Here, the base voltage of transistor Tr1 (voltage V1) has the waveform illustrated in (b) in FIG. 5. Here, the peak value of voltage V1 is, for example, approximately 5 volts.

In period T1, which is the period during which switch 53 is on, voltage V1 exceeds the threshold voltage of transistor Tr1, thereby placing transistor Tr1 in an on state. Thus, as illustrated in (c) in FIG. 5, in period T1, the collector voltage (voltage V2) of transistor Tr1 is a low-level voltage (0 volts).

However, in period T2, which is the period during which switch 53 is off, voltage V1 is pulled down to 0 volts by resistor R2 and thus below the threshold voltage of transistor Tr1, thereby placing transistor Tr1 in an off state. Thus, as illustrated in (c) in FIG. 5, voltage V2 in period T2 is a high-level voltage (Vcc).

With this, voltage V2 output from detection circuit 80 corresponds to the on and off states of switch 53 illustrated in (d) in FIG. 5. Thus, detector 17 monitors (samples) this output of detection circuit 80 to detect an instance of the momentary power-off operation of switch 53.

Lighting System Operation

Figure 6:
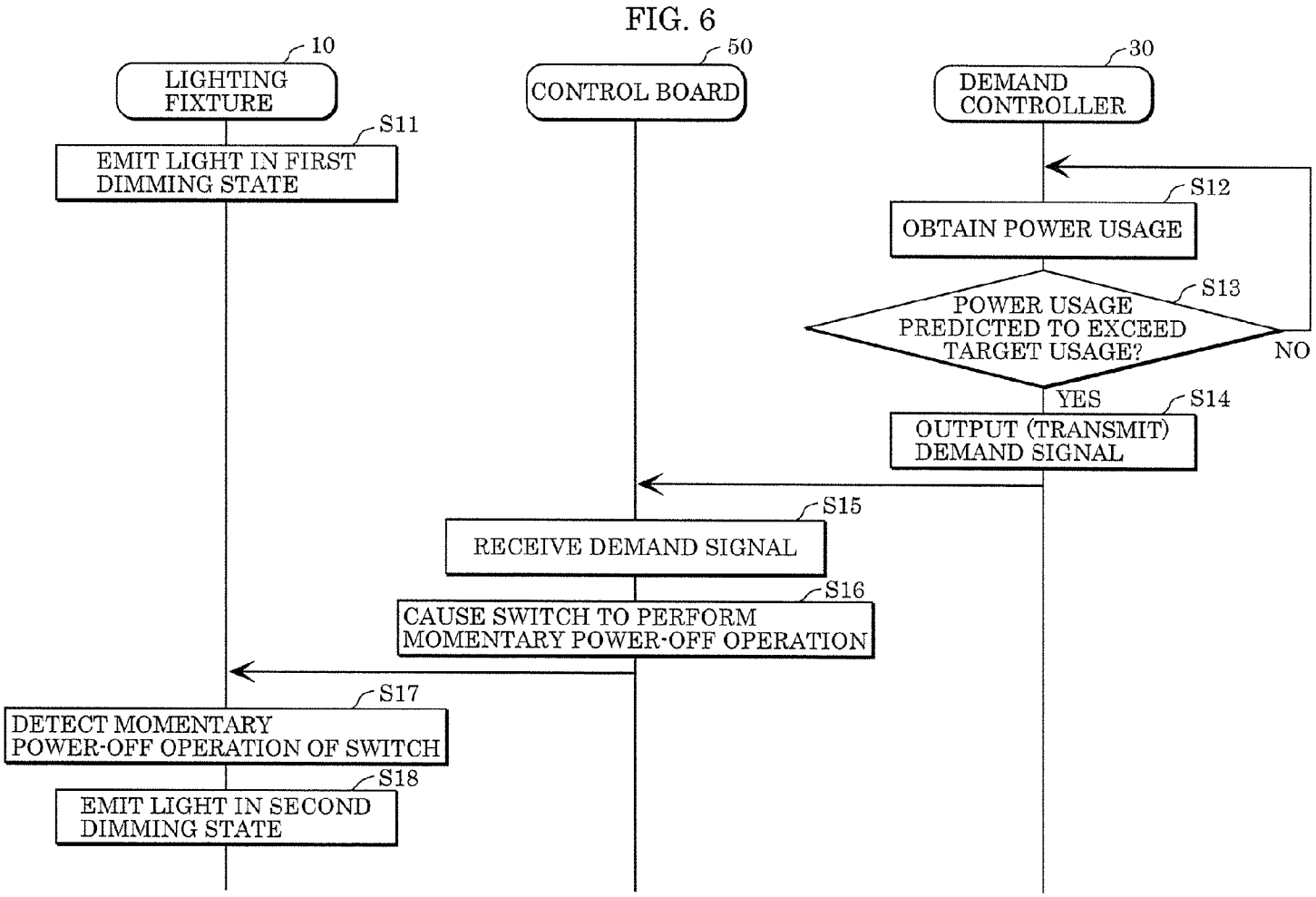
FIG. 6 is a sequence diagram of operations performed by a lighting system according to Embodiment 1.

Next, operations performed by lighting system 100 will be described with reference to FIG. 6. FIG. 6 is a sequence diagram of operations performed by lighting system 100.

First, controller 11 of lighting fixture 10 causes light emitter 12 to emit light in the first dimming state—that is to say, turns light emitter 12 fully on—(S11).

Demand controller 30 obtains the power usage from power meter 41 (S12), and determines whether the predicted power usage value will exceed the target usage (S13). As described above, in Embodiment 1, when demand controller 30 predicts that the power usage will exceed the target usage (Yes in S13), demand controller 30 outputs, to control board 50, a demand signal indicating that the power usage is predicted to exceed the target usage (S14).

Switch controller 51 of control board 50 receives the demand signal from demand controller 30 (S15), and causes the plurality of switches included in switch unit 52 to perform a momentary power-off operation (S16). For example, switch controller 51 causes switch 53 to perform a momentary power-off operation which interrupts the supply of power from power line 70 to lighting fixture 10 for the predetermined period of time.

Detector 17 of lighting fixture 10 detects the interruption of the supply of power for the predetermined period of time (S17), and controller 11 causes light emitter 12 to emit light in the second dimming state darker than the first dimming state in which light emitter 12 emitted light immediately before the detection (S18).

Advantageous Effects

As described above, in lighting system 100, switch controller 51 interrupts the supply of power to the plurality of lighting fixtures connected to distribution board 40 for a predetermined period of time in response to the demand signal being output from demand controller 30. Here, the demand signal is, for example, output when the total power usage of the devices connected to distribution board 40 is predicted to exceed a predetermined target usage.

If detector 17 of lighting fixture 10 detects that the supply of power has been interrupted for the predetermined period of time, controller 11 of lighting fixture 10 causes light emitter 12 to emit light in the second dimming state darker than the first dimming state in which light emitter 12 emitted light immediately before the detection.

In other words, in lighting system 100, when power usage increases, power consumption by lighting fixture 10 is automatically reduced. With this, power grid 60 can be stabilized during peak power consumption and electricity costs for consumers using lighting system 100 can be reduced.

For example, in Japan, contracts between energy companies and consumers may include a clause that penalizes consumers when power usage exceeds a predetermined contract demand by, for example, increasing the unit price of electricity. In this case, by setting the above-described target usage to the contract demand, power usage is less likely to exceed the contract demand, thereby reducing electricity costs for the consumer. In, for example, office buildings, there are cases where power usage by lights exceeds power usage by air conditioners. In this case, lighting system 100 can effectively reduce electricity costs.

Moreover, one feature of lighting system 100 is that it can collectively control the plurality of lighting fixtures easily using existing power lines. Consumers already using demand controller 30 can easily install lighting system 100 by simply attaching control board 50 and exchanging an existing lighting fixture for lighting fixture 10. In other words, installation of lighting system 100 does not require extensive construction work, such as laying new control wiring.

Moreover, a configuration in which a control board controls a plurality of lighting fixtures via wireless communication is conceivable, but with such a configuration, the control board and lighting fixture require, for example, relatively high-cost wireless communication modules. Thus, costs with regard to the control board and lighting fixture increase, detracting from the merits described above. Moreover, in the case of control via wireless communication, trouble may arise from interference or the control board may be unable to sufficiently control the lighting fixture due to installation in an environment with poor reception.

Such a communication module, however, is not required in lighting system 100. Since control board 50, which is made from relatively low-cost components such as switches, is used, installation costs can be reduced. Note that when a lighting fixture already in use by the consumer is compatible with a dimming function, the existing lighting fixture may be upgraded to the equivalent of lighting fixture 10 by replacing the power source block and updating the firmware (software), rather than replacing the lighting fixture.

Moreover, since lighting system 100 is configured to detect whether power is being supplied via the power line, a merit of lighting system 100 is that it can perform control with more certainty than the above-described wireless communication.

Other Embodiments

Hereinbefore, lighting system 100 according to an embodiment of the present disclosure has been described, but the present disclosure is not limited to this embodiment.

In Embodiment 1, one lighting fixture (e.g. lighting fixture 10) is connected to one switch (e.g., switch 53), but a plurality of lighting fixtures may be connected to a single switch. With this, a plurality of lighting fixtures can be controlled by causing a single switch to perform a momentary power-off operation.

Moreover, in Embodiment 1, when switch controller 51 receives the demand signal, switch controller 51 typically causes all switches included in switch unit 52 to perform a momentary power-off operation. Switch controller 51 may, however, cause a portion of the switches included in switch unit 52 to perform a momentary power-off operation in response to reception of the demand signal.

For example, as described in Embodiment 1, it is conceivable that demand controller 30 outputs the demand signal in stages in accordance with power usage (i.e., demand controller 30 first outputs a first demand signal and then outputs a second demand signal). In this case, switch controller 51 may cause half of the switches included in switch unit 52 to perform a momentary power-off operation upon reception of the first demand signal, and cause the remaining half of the switches included in switch unit 52 to perform a momentary power-off operation upon reception of the second demand signal.

In this way, when switch controller 51 is configured to cause the switches included in switch unit 52 to perform a momentary power-off operation in stages, each switch included in switch unit 52 may be assigned a priority. In other words, switch controller 51 causes a low priority switch to perform a momentary power-off operation in response to reception of the first demand signal and causes a high priority switch to perform a momentary power-off operation in response to reception of the second demand signal. With this, control can be performed as desired by the user—that is to say, lighting fixtures installed in a room that the user does not want to become dark can be controlled to have a lower chance of dimming. Note that the priority levels are stored in the storage (not illustrated in FIG. 1) in control board 50, for example.

Moreover, in Embodiment 1, the plurality of lighting fixtures are described as being fully on before a momentary power-off operation is performed, but the plurality of lighting fixtures may include a lighting fixture that is already dimmed before a momentary power-off operation is performed. If changing the already dimmed lighting fixture to the second dimming state would cause the lighting fixture to emit brighter light than before the momentary power-off operation, it is not necessary to change the lighting fixture to the second dimming state. In other words, the dimming state prior to the momentary power-off operation may be maintained. For example, while controller 11 of lighting fixture 10 is causing light emitter 12 to emit light in the second dimming state, if detector 17 detects that the supply of power has been interrupted for a predetermined period of time and the supply of power resumes, controller 11 may cause light emitter 12 to resume emitting light in the second dimming state.

Moreover, in Embodiment 1, LEDs or LED elements are used as light-emitting elements in light emitter 12. However, semiconductor light-emitting elements such as semiconductor lasers; solid-state light-emitting elements such as organic electroluminescent (EL) elements or inorganic EL elements; or fluorescent lamps may be used as light-emitting elements in light emitter 12.

Moreover, in Embodiment 1, each element may be configured in the form of specialized hardware, or may be realized by executing a software program suitable for the element. Each element may be realized by a program executing unit, such as a CPU or a processor, reading and executing the software program recorded on storage such as a hard disk or semiconductor memory.

Moreover, each element may be a circuit (or integrated circuit). These circuits may be configured as a single circuit and, alternatively, may be individual circuits. Moreover, these circuits may be ordinary circuits and, alternatively, may be specialized circuits.

Moreover, general or specific aspects of the present disclosure may be realized as a system, device, method, integrated circuit, computer program, computer readable medium such as a CD-ROM, or any given combination thereof. For example, one or more exemplary embodiments may be realized as lighting fixture 10 used in lighting system 100. One or more exemplary embodiments may also be realized as control board 50 (the control device).

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting system comprising:

a lighting fixture that is to be connected to a distribution board via a power line and emits light when supplied with power over the power line;

a demand controller that obtains power usage of a plurality of devices, including the lighting fixture, connected to the distribution board via power lines, and outputs a demand signal based on the power usage obtained; and a control device including:

a switch provided on the power line connected to the lighting fixture; and a switch controller that interrupts supply of power over the power line for a predetermined period of time by controlling the switch based on the demand signal output by the demand controller, wherein the lighting fixture includes:

a light emitter that emits light when supplied with power over the power line;

a detector that detects an interruption in the supply of power; and a controller that causes the light emitter to emit light in a second dimming state if the detector detects that the supply of power has been interrupted for the predetermined period of time, the second dimming state being darker than a first dimming state in which the light emitter emitted light immediately before the detection that the supply of power has been interrupted for the predetermined period of time.

2. The lighting system according to claim 1, wherein while the controller is causing the light emitter to emit light in the second dimming state, if the detector detects that the supply of power has been interrupted for longer than the predetermined period of time and the supply of power resumes, the controller causes the light emitter to emit light in the first dimming state upon the power being resumed.

3. The lighting system according to claim 1, wherein while the controller is causing the light emitter to emit light in the second dimming state, if the detector detects that the supply of power has been interrupted for the predetermined period of time and the supply of power resumes, the controller causes the light emitter to resume emitting light in the second dimming state upon the power being resumed.

4. The lighting system according to claim 1, wherein the lighting fixture further includes a setting receiver that receives a user setting for the first dimming state and the second dimming state.

5. The lighting system according to claim 1, wherein the demand controller outputs the demand signal if the power usage obtained is predicted to exceed a predetermined target usage.

6. The lighting system according to claim1 , wherein the lighting fixture comprises a plurality of lighting fixtures, the demand controller obtains power usage of a plurality of devices including the plurality of lighting fixtures, the switch comprises a plurality of switches each corresponding to one of the plurality of lighting fixtures, and the switch controller interrupts the supply of power to the plurality of lighting fixtures for the predetermined period of time by controlling the plurality of switches based on the demand signal output by the demand controller.

7. The lighting system according to claim 1, wherein the predetermined period of time is between one second and two seconds, both inclusive.

8. The lighting fixture included in the lighting system according to claim 1.

9. A control device comprising:

a switch provided on a power line connecting a distribution board and a lighting fixture; and a switch controller that interrupts supply of power to the lighting fixture for a predetermined period of time by controlling the switch based on a demand signal outputted depending on power usage of a plurality of devices, including the lighting fixture, connected to the distribution board via power lines, wherein when the supply of power to the lighting fixture has been interrupted by the switch controller for the predetermined period of time, the control device causes the lighting fixture to emit light in a second dimming state darker than a first dimming state in which the lighting fixture emitted light immediately before the detection.

* * * * *